US005375516A

United States Patent [19]

Hasegawa

[11] Patent Number: 5,375,516

[45] Date of Patent: Dec. 27, 1994

[54] STENCIL PRINTING DEVICE HAVING A PLURALITY OF PRINTING DRUMS ARRANGED ON AN INCLINE

[75] Inventor: Takanori Hasegawa, Tokyo, Japan

[73] Assignee: Riso Kagaku Corporation, Tokyo, Japan

[21] Appl. No.: 91,137

[22] Filed: Jul. 14, 1993

[30] Foreign Application Priority Data

Jul. 16, 1992 [JP] Japan ..... 4-189059
Jul. 22, 1992 [JP] Japan ..... 4-195315
Jul. 22, 1992 [JP] Japan ..... 4-195316

[51] Int. Cl.[5] ..... B41F 15/10; B41F 15/22; B41F 15/40

[52] U.S. Cl. ..... 101/116; 101/118; 101/119; 101/128.4; 101/477; 101/115

[58] Field of Search ..... 101/114, 115, 116, 117, 101/118, 119, 120, 128.21, 128.4, 129, 477, 181, 183

[56] References Cited

U.S. PATENT DOCUMENTS 3,198,109 8/1965 Dwyer et al. ..... 101/119
4,099,461 7/1978 Mitter ..... 101/119
4,436,032 3/1984 van Ouwerkerk ..... 101/120
4,628,813 12/1986 Hasegawa et al. ..... 101/128.4
4,998,470 3/1991 Klemm ..... 101/115
5,048,416 9/1991 Tijima ..... 101/115
5,207,157 5/1993 Okazaki et al. ..... 101/116
5,224,419 7/1993 Fukai ..... 101/128.4

FOREIGN PATENT DOCUMENTS 55-889 4/1980 Japan ..... 101/120
161187 8/1985 Japan ..... 101/119
158285 7/1988 Japan ..... 101/120
57357 2/1990 Japan ..... 101/128.4

*Primary Examiner*—Edgar S. Burr
*Assistant Examiner*—Stephen R. Funk
*Attorney, Agent, or Firm*—Dickstein, Shapiro & Morin

[57] ABSTRACT

To provide a stencil printing device of a multi printing drum type which can be reduced in size without complicating the path of conveying printing paper and without compromising the ease of maintenance, a plurality of printing drums are arranged along an inclined line of a prescribed angle of inclination, and the path of conveying printing paper between each pair of adjacent printing drums is defined, for instance, as a straight line. A plate making unit, a plate ejection unit and a paper feeding unit are arranged in the space defined above and below the inclined line along which the printing drums are arranged so that a compact design may be accomplished.

11 Claims, 10 Drawing Sheets

STENCIL PRINTING DEVICE HAVING A PLURALITY OF PRINTING DRUMS ARRANGED ON AN INCLINE

TECHNICAL FIELD

The present invention relates to a stencil printing device, and in particular to a rotary stencil printing device suitable for use as a multi color stencil printing device.

BACKGROUND OF THE INVENTION

As a well known rotary stencil printing device, there is known the fully automated stencil printing device of a single printing drum type equipped with the function of making stencil printing master plates which comprises a printing drum internally provided with ink squeegee means for supplying printing ink and is adapted to be rotatively driven around an axial center line thereof, a stencil printing master plate feeding means disposed substantially laterally or horizontally opposite to the printing drum, and comprising a plate making portion for processing a stencil printing master plate sheet, and a stencil printing master plate sheet feeding portion for delivering the stencil printing master plate sheet to the outer circumferential surface of the printing drum, plate ejection means disposed substantially horizontally opposite to the printing drum for removing a stencil printing master plate mounted on the outer circumferential surface of the printing drum therefrom, a press roller disposed opposite to the outer circumferential surface of the printing drum for pressing printing paper against the outer circumferential surface of the printing drum, timing roller means for supplying printing paper to a nip defined between the printing drum and the press roller at an appropriate timing, and paper feed means for feeding printing paper to the timing roller means for supplying printing paper one sheet at a time. Such a fully automated stencil printing device of a single printing drum type equipped with the function of making stencil printing master plates is disclosed for instance in Japanese patent laid open (kokai) publication No. 59-96983.

When a full color printing or other multi color printing is attempted by using such a stencil printing device, it is necessary to superimpose picture images of different colors on printing paper by using a plurality of printing drums one after the other. Since the replacement of the printing drums has to be carried out manually, it is necessarily inefficient, and the registration involved in each step of printing the image of each color is So difficult that it is not possible for an inexperienced user to carry out such a printing process successfully.

On the other hand, it is conceivable to use a stencil printing device of a multi printing drum type which is provided with a plurality of printing drums for the printing of different colors so that the entire printing process can be carried out in a continuous manner by automatically conveying the printing paper from one printing drum to another. However, according to such a stencil printing device, since at least three, more preferably four printing drums are required in the case of full color printing, the printing device tends to be large in size. Further, since stencil printing master plate sheet feeding means and plate ejection means have to be equipped to each of the printing drums, and this necessity makes the size of the stencil printing device so large that the printing device cannot be made acceptable for most office uses.

To reduce the size of the stencil printing device of a multi printing drum type, it is conceivable to arrange the printing drums both vertically and laterally, but it would make the path of feeding printing paper so tortuous that the possibility of occurrence of paper jams would be unacceptably high, and the effort required to remove jammed paper may be substantial.

BRIEF SUMMARY OF THE INVENTION

In view of such problems of the conventional stencil printing device, a primary object of the present invention is to provide a stencil printing device of a multi printing drum type which may be made compact in size without complicating the path for conveying printing paper.

A second object of the present invention is to provide a stencil printing device of a multi printing drum type which is reliable in operation.

A third object of the present invention is to provide a stencil printing device of a multi printing drum type which is easy to maintain.

A fourth object of the present invention is to provide a stencil printing device equipped with an ink supplying device which can prevent the printing ink in axial end regions of the ink reservoir of each printing drum from being kept unused for an extended period of time, which can maintain a stable print quality, and which can avoid the inconvenience of involving leakage of printing ink from the ink reservoir.

A fifth object of the present invention is to provide a stencil printing device equipped with an ink level detecting device which is free from erroneous detection results, and allows the level of the printing ink to be detected in both reliable and stable fashion without being interfered by external influences even when the ink reservoir is located in a narrow region located between a squeegee member and a metallic printing drum.

According to the present invention, these and other objects can be accomplished by providing a stencil printing device, comprising: a plurality of printing drums arranged in a single row along an inclined line of a prescribed inclination angle relative to a horizontal line in mutually spaced relationship, each of the printing drums being rotatively driven around an axial center line thereof; a stencil printing master plate feeding means disposed above the inclined line in association with each of the printing drums, the stencil printing master plate feeding means comprising a plate making portion for processing a stencil printing master plate sheet, and a stencil printing master plate sheet feeding portion for delivering the stencil printing master plate sheet processed by the plate making portion to an outer circumferential surface of the corresponding printing drum; plate ejection means disposed above the inclined line in association with each of the printing drums for removing a stencil printing master plate mounted on the outer circumferential surface of the printing drum therefrom; squeegee means disposed inside each of the printing drums for supplying printing ink to the outer circumferential surface of the printing drum; a press roller disposed below the inclined line and opposite to the outer circumferential surface of each of the printing drums for pressing printing paper against the outer circumferential surface of the printing drum; printing paper conveying means disposed between each pair of mutually adjacent ones of the printing drums for conveying printing paper along the inclined line from the upstream printing drum to a nip defined between the downstream printing drum and the corresponding press roller; timing roller means for supplying printing paper to a nip defined between the most upstream one of the printing drums and the corresponding press roller at an appropriate timing; paper feed means disposed below the inclined line for delivering the printing paper to the timing roller means; and paper ejection means for ejecting paper from the most downstream one of the printing drums.

According to this stencil printing device, a stencil printing master plate is produced at the plate making portion provided in association with each of the printing drums, and the produced stencil printing master plate is mounted on the outer circumferential surface of the corresponding printing drum. During the process of printing, the printing paper is supplied by the paper feed means one sheet at a time, and is then delivered to the timing roller means for feeding the printing paper to the most upstream one of the printing drums. The timing roller means supplies the printing paper to the nip between the most upstream printing drum and the corresponding press roller. The printing paper interposed between the most upstream printing drum and the corresponding press roller is pushed against the outer circumferential surface of the printing drum, and by thus being pushed against the stencil printing master plate which is already mounted on the printing drum, a printed image is formed on the printing paper by deposition of the printing ink selectively passed through the stencil printing master plate. The printing paper is then conveyed by the printing paper conveying means along the inclined line along which the printing drums are arranged, and is fed to the nip between the downstream printing drum and the corresponding press roller. Again, the printing paper is pressed against the stencil printing master plate already mounted on the outer circumferential surface of the downstream printing drum, and a printed image is superimposed on the printing paper by deposition of printing ink from the stencil printing master plate. This process is repeated for each of the printing drums. Since the path of conveying the printing paper could be made simple, for instance substantially straight, the possibility of paper jam is minimized, and the simple structure ensures a reliable operation, and simplifies the work involved in its maintenance. In particular, since the feeding of the paper along the inclined line is assisted by the gravity, a highly reliable and stable paper feeding action is possible.

According to a preferred embodiment of the present invention, the stencil printing master plate feeding means is disposed opposite to a side of the corresponding printing drum remote from the inclined line, and this structure ensures a reliable operation of feeding stencil printing master plates to the corresponding printing drum in a highly reliable and stable fashion.

According to a particularly preferred embodiment of the present invention, the plate ejection means as well as the stencil printing master plate feeding means is disposed opposite to a side of the corresponding printing drum remote from the inclined line, and the plate ejection means is disposed below the stencil printing master plate feeding means.

To achieve a highly compact design of the stencil printing device, the stencil printing device may comprise a substantially box-shaped cabinet, and the inclined line may extend substantially diagonally across the interior of the cabinet in a plane perpendicular to the central axial lines of the printing drums, the paper feeding means being disposed in a first corner portion of the cabinet below the inclined line as seen in this plane. It is preferred that the stencil printing device further comprises image reading means for photoelectrically reading an image from an original, and plate making data processing means for receiving the image signal from the image reading means and supplying a plate making data signal to the plate making portion of the stencil printing master plate sheet feeding means, the image reading means being disposed in a second corner portion of the cabinet above the inclined line and diagonally opposite to the first corner as seen in this plane.

In such a stencil printing device, the plate making portion of the stencil printing master plate sheet feeding means may be adapted to digitally produce a stencil printing master plate according to the image data signal supplied from the plate making data processing means. The plate making data processing means may supply plate making data signals obtained by a process of color separation to the plate making portion of the stencil printing master plate sheet feeding means so that a full color printing process may be carried out.

When the printing device is provided with the image reading means and the plate making data processing means, the image of the original is photoelectrically read by the image reading means, and the plate making data signal thus obtained is supplied to the plate making portion of the stencil printing master plate sheet feeding means of each of the printing drums. According to this plate making data signal, the plate making portion of the stencil printing master plate sheet feeding means of each of the printing drums digitally processes the stencil printing master plate sheet for stencil printing.

When color signals are separated from the image signal obtained by image reading portion, the plate making data signal obtained for each of the separated colors is supplied to the plate making portion of the stencil printing master plate feeding means of each of the printing drums, and the plate making portion of the stencil printing master plate sheet feeding means of each of the printing drums digitally processes the stencil printing master plate sheet for stencil printing as a dot matrix for each of the colors.

To minimize the cost, the stencil printing master plate feeding means may consist of a single unit which is moveable along the inclined line so that the single stencil printing master plate feeding means may supply a stencil printing master plate to each of the printing drums in a sequential manner.

The ink supplying device for stencil printing devices normally comprises either a roller or a squeegee blade which extends in the axial direction of the printing drum and engages the inner circumferential surface of the printing drum, and the squeegee member supplies the printing ink received in an ink reservoir extending in the axial direction of the printing drum to the printing drum by the action of the squeegee blade, and such ink suppling devices are disclosed in Japanese patent laid open (kokai) publications Nos. 55-55889 and 03-240584.

Stencil printing normally involves margins on either side of the printing paper, and the printed image rarely extends over the entire width of the printing paper.

Therefore, in such an ink supplying device, the printing ink in the central part of the ink reservoir as seen in the axial direction is consumed relatively rapidly while the printing ink on either axial end of the ink reservoir is not consumed so rapidly.

If the printing ink in the central part of the ink reservoir as seen in the axial direction is consumed relatively rapidly while the printing ink on either axial end of the ink reservoir is not consumed so rapidly, the amount of the printing ink in the central part tends to be greater than the amount of the printing ink on either axial end with the result that the printing ink located on either axial end tends to flow toward the central part of the ink reservoir.

However, this flow cannot quite fully compensate for the difference in the consumption of printing ink between these two regions, and the amount of the printing ink on either axial end of the ink reservoir remains to be greater than that in the central part of the ink reservoir.

Further, the printing ink located on either axial end of the ink reservoir tends to stagnate therein, and continues to stay in the same region for an extended period of time. Therefore, when the printing ink consists of an emulsion type, the printing ink may lose its viscosity due to the change in the condition of the emulsion in time, and may become excessively fluid.

The increased fluidity of the printing ink causes the blurring of edges of images, and the printing ink is made more prone to leakage from the ink reservoir.

Such problems of the conventional stencil printing device can be eliminated if the stencil printing device is equipped with an ink supplying device which includes a squeegee member extending in the axial direction of a rotatively driven printing drum and engaging the inner circumferential surface of the printing drum for supplying the printing ink received in an ink reservoir extending in the axial direction of the printing drum to the printing drum by the action of the squeegee member, the ink supplying device further comprising: an ink circulating pump comprising an ink suction port and an ink expelling port provided in two separate positions, the printing ink in the ink reservoir being drawn into the ink suction port, and the printing ink being expelled from the ink expelling port to the ink reservoir.

According to this structure, the ink circulating pump draws the printing ink in the ink reservoir from its ink suction port, and expels it back to the ink reservoir from its ink expelling port, and forces the circulation of the printing ink in the ink reservoir. Thus, the problems associated with the unevenness in the distribution of the Consumption of the printing ink in the ink reservoir can be avoided.

Stencil printing devices of the above described type are typically equipped with an ink level detecting device which detects the level of the printing ink in the ink reservoir for the purpose of controlling the supply of the printing ink to the ink reservoir.

According to a conventional ink level detecting device, the change in the level of the printing ink in the ink reservoir Is detected by the change in the electrostatic capacitance between a detecting electrode member and a ground electrode member which oppose each other in the ink reservoir. Japanese utility model publication (kokoku) No. 3-28342, Japanese patent publication (kokoku) No. 1-33352 and Japanese patent laid open publication (kokai) No. 62-146632 disclose such ink level detecting devices.

According to such an electrostatic capacitance type ink level detecting device, erroneous detection results may be produced when the circuit board of the detecting device is contaminated by the printing ink or when the device is placed in an electrically unstable environment. In particular, when the ink reservoir is located in a narrow region located between a squeegee member and a metallic printing drum as is the case with the ink level detecting device disclosed in Japanese patent laid open publication (kokai) No. 3-240584, an electrically stable environment cannot obtained, and erroneous detection results tend to be produced.

Such problems of the conventional stencil printing device can be eliminated if the stencil printing device is equipped with an ink level detecting device which includes a squeegee member extending in the axial direction of a rotatively driven printing drum and engaging the inner circumferential surface of the printing drum, the printing ink received in an ink reservoir extending in the axial direction of the printing drum being supplied to the printing drum by the action of the squeegee member, the ink level detecting device further comprising: an ink circulating pump which comprises an ink suction port at a position which is spaced from the printing ink in the ink reservoir when the level of the printing ink in the ink reservoir is below a prescribed level, and draws the printing ink received in the ink reservoir from the ink suction port and returns the printing ink back to the ink reservoir from an ink ejection port; and ink suction detecting means for determining if the ink circulating pump Is drawing the printing ink or not; the level of the printing ink in the ink reservoir being determined to be below the prescribed level or not according to a result of determination by the ink suction detecting means.

According to this structure, when the level of the printing ink in the ink reservoir is below the prescribed level, the ink circulating pump starts drawing air instead of the printing ink, and it is detected by the ink suction detecting means as an indication that the level of the printing ink in the ink reservoir is below the prescribed level. Thus, no sensor which tends to be sensitive to external interferences is required, and, for instance, the system for circulating the printing ink in the ink reservoir can be conveniently utilized for producing a means for detecting the level of the printing ink in the ink reservoir.

BRIEF DESCRIPTION OF THE DRAWINGS

Now the present invention is described in the following with reference to the appended drawings, in which.

DETAILED DESCRIPTION OF THE PREFERRED EMBODIMENTS

Now the preferred embodiments of the present invention are described in the following with reference to the appended drawings.

Figure 1:
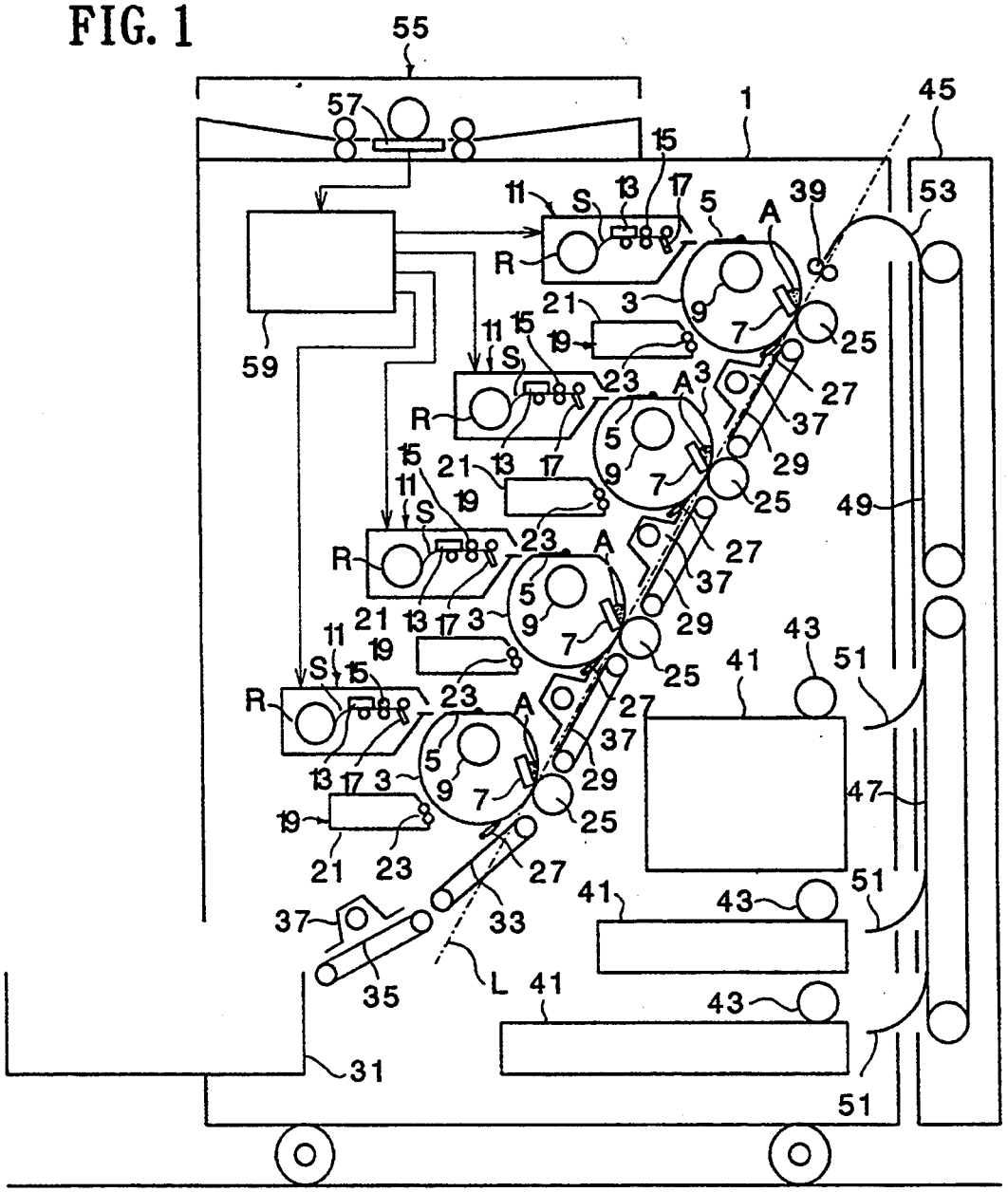
FIG. 1 is a schematic structural view of an embodiment of the stencil printing device according to the present invention.
Figure 2:
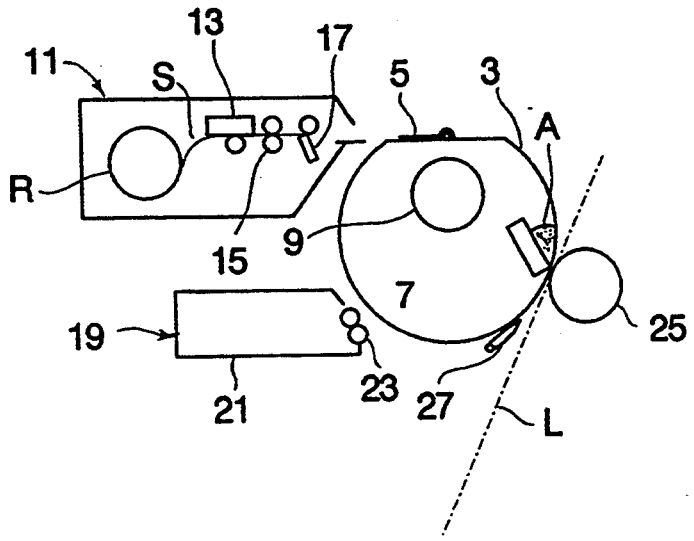
FIG. 2 is an enlarged structural view showing a part of the stencil printing device of FIG. 1.

FIGS. 1 and 2 show an embodiment of the stencil printing device according to the present invention. In these drawings, numeral 1 denotes a cabinet of a stencil printing device. This cabinet 1 is box-shaped, and contains therein a plurality of (four in the illustrated embodiment) printing drums 3 arranged along an inclined line L having a prescribed angle of inclination for instance 60 degrees with respect to the horizontal line in a single row in mutually spaced relationship.

Each of the printing drums 3 can be rotated around its axial center line, and is adapted to be rotatively driven by a servo motor or the like not shown in the drawings in clockwise direction as seen in the drawings. Each of the printing drums 3 comprises a cylindrical shell made of porous metallic plate, a mesh assembly or otherwise ink permeable material, and has a D-shaped cross section including a flattened section, in the case of the illustrated embodiment. The flattened section of the printing drum 3 is provided with a head clamp plate 5 for securing a stencil printing master plate sheet wrapped around the outer circumferential surface of the printing drum 3.

Each of the printing drums 3 is internally provided with a fixed squeegee blade 7 for supplying printing ink. The squeegee blade 7 engages with the inner circumferential surface of the printing drum 3 so as to define an ink reservoir A in a substantially triangular region defined by the squeegee blade 7 and the inner circumferential surface of the printing drum 3, and supplies the printing ink stored in this ink reservoir A to the printing drum 3 as the printing drum 3 rotates according to the known principle of squeegee operation.

In this case, the ink reservoir A has the shape of the letter V in an upright orientation, and the printing ink contained in this ink reservoir A stays within this ink reservoir A in conformity with the shape of the ink reservoir A even when the rotation of the printing drum 3 is interrupted. The squeegee angle in this case may be approximately 30 degrees.

When the printing drum 3 has such a D-shaped cross section, the squeegee blade 7 is actuated so as to follow the contour of the inner circumferential surface of the printing drum 3. For more details of the mode of actuating the squeegee blade 7, reference should be made to the specifications and drawings of Japanese patent applications Nos. 3-235130 and 4-22323 filed by the same applicant as that of this application.

Each of the printing drums 3 is further internally provided with an ink supplying tube 9, and an ink supplying device which although not shown in the drawings draws printing ink out of the ink supplying tube 9 and supplies a prescribed amount of printing ink to the ink reservoir A as required.

The ink supplying tubes 9 of the printing drums 3 may contain printing inks of different colors, for instance yellow, magenta, cyan and black inks for fullcolor printing so that they may be supplied to the ink reservoirs A of the corresponding printing drums 3.

For each of the printing drums 3, a stencil printing master plate sheet feeding unit 11 is provided above the line of inclination L and substantially horizontally adjacent to and opposite to the corresponding printing drum 3. Each of the stencil printing master plate feeding units 11 comprises a roll of thermal stencil printing master plate sheet S, a thermal head 13 for digitally making a stencil printing master plate by thermally perforating the stencil printing master plate sheet S in a dot matrix, stencil printing master plate sheet feeding rollers 15 for feeding the stencil printing master plate sheet S thermally processed by the thermal head 13 onto the outer circumferential surface of the corresponding printing drum 3, and a stencil printing master plate sheet cutter 17 for cutting the stencil printing master plate sheet S. The vertical level at which the stencil printing master plate sheet S is fed by the stencil printing master plate sheet feeding rollers 15 substantially corresponds to the position of the head clamp plate 5 on the printing drum 3 at its initial position or is slightly higher than it so that the stencil printing master plate sheet S fed out from the stencil printing master plate sheet feeding rollers 15 may reach the head clamp plate 5 of the printing drum 3 at its initial position.

Further, a plate ejection unit 19 is provided for each of the printing drums 3 above the line of inclination L but below the stencil printing master plate feeding unit 11 in a substantially horizontally offset relationship to the printing drum 3.

Each of the plate ejection units 19 comprises plate ejection rollers 23 which peel off the stencil printing master plate wrapped around the outer circumferential surface of the printing drum 3 therefrom, and conveys it into an ejected plate storage box 21.

A press roller 25 is provided in association with each of the printing drums 3 at a position below the line of inclination L. Each of the press rollers 25 opposes the outer circumferential surface of the corresponding printing drum 3, and is selectively pushed against the outer circumferential surface of the printing drum 3 by press roller driving means not shown in the drawing in synchronism with the rotation of the printing drum 3.

Printing paper separation claws 27 are provided at a position adjacent to each of the printing drums 3 and downstream to the corresponding press roller 25 with respect to the direction of the movement of the printing paper.

Between each pair of adjacent printing drums 3 is provided a fixed conveying device 29 for conveying printing paper from one printing drum to another along the line of inclination L. The conveying device 29 comprises an endless belt conveyer, and suction means for retaining the printing paper onto the endless belt conveyer by suction, and can convey the printing paper between the adjacent printing drums 3 along the line of inclination L without touching the upper (printed) surface of the printing paper. The printing paper is eventually fed into the nip between the downstream printing drum 3 and the associated press roller 25. This conveying device 29 of the suction type may be similar in structure to the printing paper conveying means for ejecting printing paper, and, for more details of this printing paper conveying means, reference should be made to Japanese utility model publication (kokoku) No. 2-35717.

A pair of paper ejection conveying devices 33 and 35 of the suction type similar to the conveying device 29 is provided between the printing drum 3 on the most downstream end and a paper ejection table 31 mounted on the bottom end of the cabinet 1.

A drying heater 37 is provided above each of the conveying devices 29 and the paper ejection conveying device 35 for heating and drying the printing ink deposited on the printing paper for forming printed images.

A pair of timing rollers 39 are provided above the most upstream printing drum 3. The timing rollers 39 are rotatively driven by a motor not shown in the drawing, and is adapted to feed the printing paper to the nip between the most upstream printing drum 3 and the corresponding press roller 25 one sheet at a time at a prescribed timing.

Paper feeding trays 41, consisting of three vertically stacked trays in the illustrated embodiment, are placed in a triangular region defined below the line of inclination L. A paper separation roller 43 is provided above each of the paper feeding trays 41 for feeding the printing paper one sheet at a time from the corresponding paper feeding tray 41.

On one side of the cabinet 1 is provided a printing paper conveying unit 45 which can be selectively opened and closed. The printing paper conveying unit 45 comprises belt conveying devices 47 and 49 and paper feed guide plates 51 and 53 for vertically conveying the printing paper fed out from each of the paper feeding trays 41 to the timing rollers 39.

An original reading unit 55, provided in an upper part of the cabinet 1, comprises an image scanner 57 for photoelectrically reading the image of the original.

The image signal obtained by the image scanner 57 by photoelectrically reading the original is supplied to a master plate image data processing device 59. The master plate image data processing device 59 separates color signals from the image signal obtained from the original, and produces master plate data signals for different colors which are eventually supplied to the thermal heads 13 of the corresponding stencil printing master plate feeding units 11.

According to the structure described above, the image of the original is photoelectrically read by the image scanner 57 of the image reading unit 55, and the image signal is supplied to the stencil printing master plate data processing unit 59. The stencil printing master plate data processing unit 59 which has received the image signal obtained from the original separates color signals from the image signal, and produces plate making data signals for different colors such as yellow, magenta, cyan and black which are eventually supplied to the thermal heads 13 of the corresponding stencil printing master plate feeding units 11.

As the thermal head 13 of each of the stencil printing master plate sheet feeding units 11 receives the corresponding plate making signal, the thermal head 13 forms a perforated image on the stencil master plate sheet S as a digitally processed dot matrix for the printing of the corresponding color.

At the same time, the stencil printing master plate mounted on each of the printing drums 3 which is not needed any more is peeled off from the printing drum 3 by the plate ejection rollers 23 of the corresponding plate ejection unit 19.

As described above, the stencil printing master plate sheet S which is processed at each of the stencil printing master plate sheet feeding units 11 for the stencil printing of the corresponding color is fed to the outer circumferential surface of the corresponding printing drum 3 by the corresponding stencil printing master plate feeding rollers 15, and is mounted on the outer circumferential surface of the printing drum 3 as the printing drum 3 rotates in clockwise direction with the leading edge of the stencil printing master plate sheet S being clamped by the master plate head clamping plate 5 associated with the printing drum 3. The stencil printing master plate sheet S is cut into an appropriate length by the master plate cutter 17. This completes the steps of processing each of the stencil printing master plate sheets S and mounting the thus prepared stencil printing master plate on the corresponding printing drum.

When carrying out the step of printing, printing paper of a prescribed size is supplied from one of the paper feed trays 41 by the corresponding paper separation roller 43 onto the printing paper conveying unit 45 one sheet at a time. The printing paper is vertically conveyed by the belt conveyer devices 47 and 49 while guided by the paper feed guide plate 51, and, after being reversed by the paper feed guide plate 53, is delivered to the timing rollers 39.

The timing rollers 39 feed the printing paper to the nip between the most upstream printing drum 3 and the corresponding press roller 25 at an appropriate timing, and the printing paper interposed between the most upstream printing drum 3 and the corresponding press roller 25 is pushed against the outer circumferential surface of the printing drum 3 by the press roller 25. As a result, the printing paper is pushed against the stencil printing master plate wrapped around the outer circumferential surface of the printing drum 3, and a desired printed image, for instance for the yellow color, is formed on the upper surface of the printing paper by deposition of printing ink.

This printing paper is then conveyed along the inclined row of the printing drums (line of inclination L) without its printed image being touched, and is fed to the nip between the adjacent and downstream printing drum 3 and the corresponding press roller 25. During this conveying process, the printing ink forming the printed image on the printing paper is heated and dried by the drying heater 37.

The printing paper is then pushed against the outer circumferential surface of the downstream printing drum 3 by the cooperation of this printing drum 3 and the corresponding press roller 25. As a result, the printing paper is pushed against the stencil printing master plate wrapped around the outer circumferential surface of the printing drum 3, and a desired printed image, for instance for the magenta color, is superimposed on the upper surface of the printing paper by deposition of printing ink.

By thus repeating the action for each of the printing drums, and by further superimposing printed images, for instance of the cyan and black colors, on the same printing paper, a full color printing can be accomplished.

When the printing process is all completed on a particular sheet of printing paper, the paper sheet is ejected by the paper ejection devices 33 and 35 onto the paper ejection table 31. During this process of conveying the ejected paper also, the printing ink deposited on the printing paper for forming the printed images is heated and dried by the drying heater 37.

The stencil printing master plate data processing unit 59 described above is not necessarily required to have the function of separating colors from the original image, and may simply supply a plurality of plate making data signals obtained from a plurality of originals sequentially read by the image scanner 57 of the image reading unit 55 to the thermal head 13 of each of the printing drums 3 simply for the purpose of printing according to the principle of superimposition.

In this stencil printing device, if only a part of the printing drums are used, for instance for monochromatic printing, two-color printing or the like, the unused printing drums 3 are kept stationary with the flattened portion of each of the unused printing drums 3 facing the corresponding press roller 25 so that the printing paper may pass through the gap defined between each of the unused printing drums 3 and the corresponding press roller 25 without being obstructed.

Figure 3:
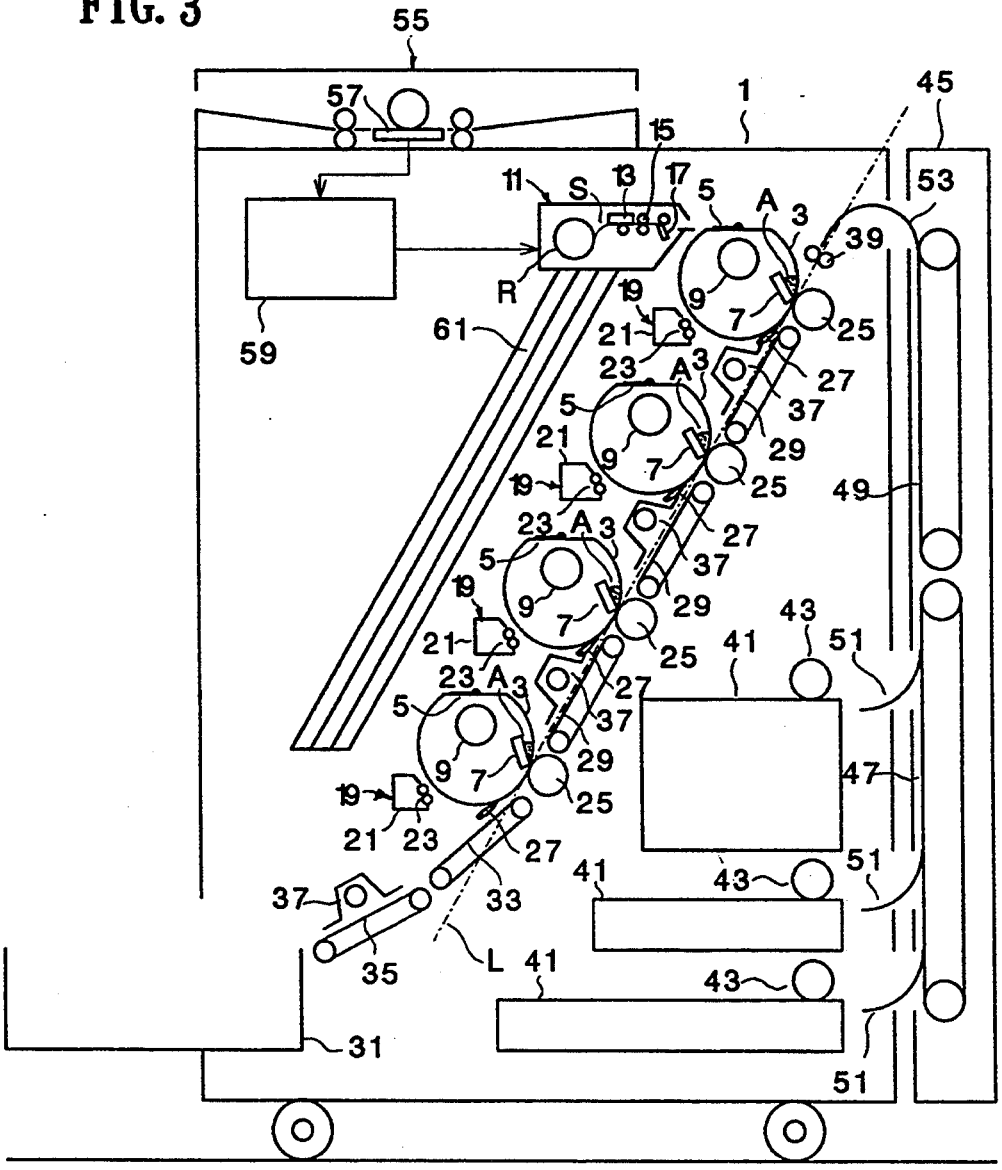
FIG. 3 is a schematic structural view of another embodiment of the stencil printing device according to the present invention.

In the above described embodiment, the stencil printing master plate sheet feeding units 11 are fixedly provided in an equal number as the printing drums 3, and in one-on-one correspondence to the printing drums 3, but it is also possible to provide a single stencil printing master plate sheet feeding unit 11 which can move along the line of inclination L by means of a guide rail 61 as illustrated in FIG. 3 so that the single stencil printing master plate sheet feeding unit 11 may be selectively moved to the prescribed position associated with each of the printing drums 3.

In this case, the single stencil printing master plate sheet feeding unit 11 performs the process of plate making for all of the printing drums, and can consist of a single unit irrespective of the number of the printing drums.

Figure 4:
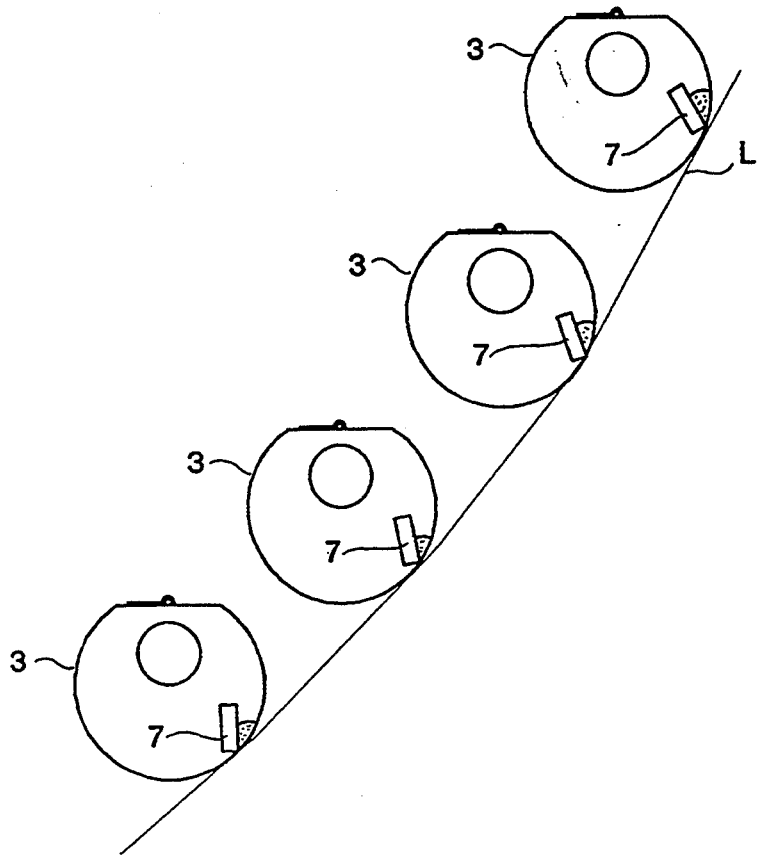
FIG. 4 is a layout diagram for the printing drums according to yet another embodiment of the stencil printing device of the present invention.

It is desirable if the line of inclination extends as a single straight line in view of ensuring the reliability of the process of feeding the printing paper, but may gradually bend or curve as illustrated in FIG. 4 as long as it is substantially straight in the segment extending each pair of adjacent printing drums 3 without any pronounced bending or curving because such bending or curving would not substantially reduce the reliability of the process of feeding the printing paper.

As can be understood from the above description, according to the stencil printing device of the present invention, since the printing drums are arranged in a single row along a vertically inclined line of a prescribed angle in a mutually spaced relationship, the path for conveying the printing paper consists of a substantially straight line between each pair of adjacent printing drums without complicating the path of the conveying the printing paper. Thus, the possibility of paper Jams can be reduced, and even when a paper jam has occurred, it can be readily removed in an efficient manner. In addition to such an advantage in maintenance, by accommodating the plate making means, plate ejection means and paper feeding means in the space above and below the inclined line along which the printing drums are arranged, compact design of the stencil printing device is made possible, and an improved stencil printing device of multi printing drum type can be provided without requiring any large space for its installation.

Figure 5:
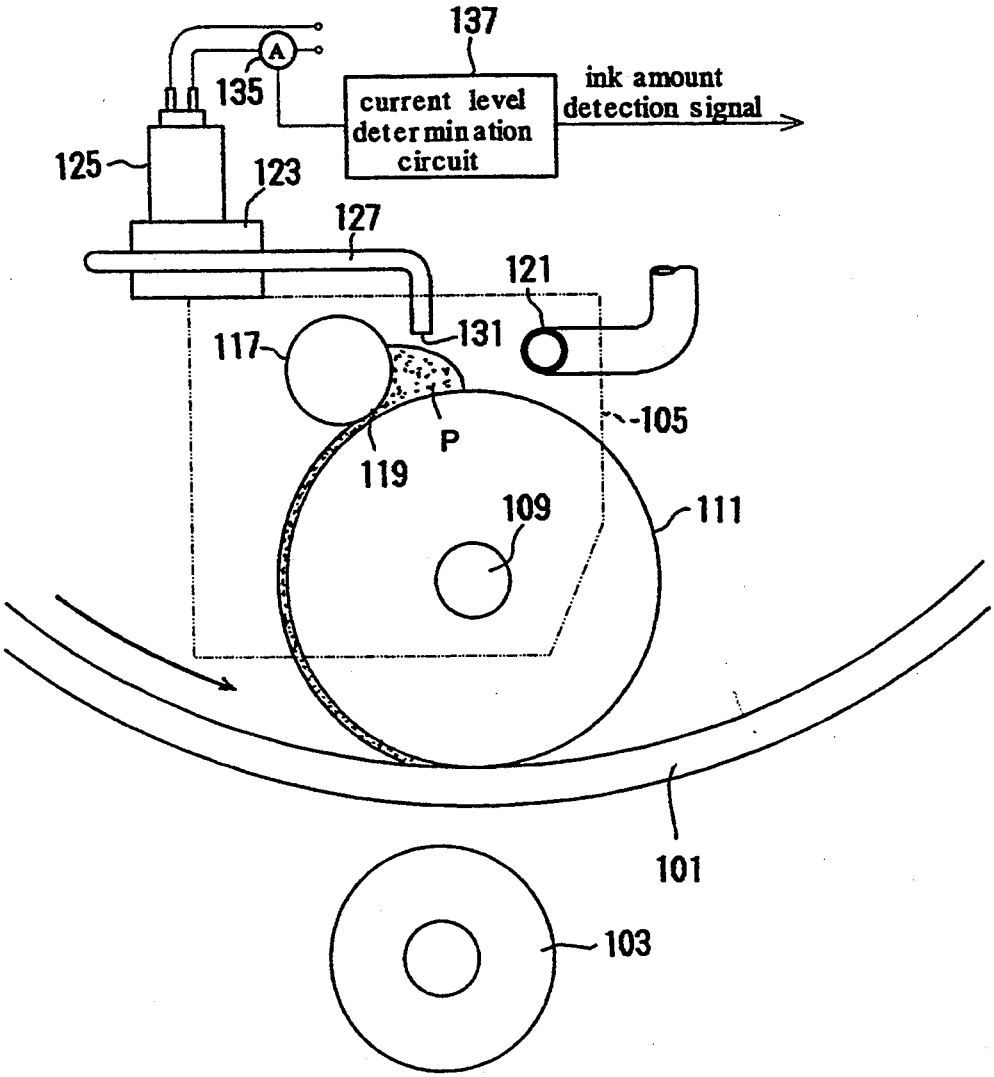
FIG. 5 is a schematic side view showing an embodiment of the ink supplying and ink level detecting device for the stencil printing device according to the present invention.
Figure 6:
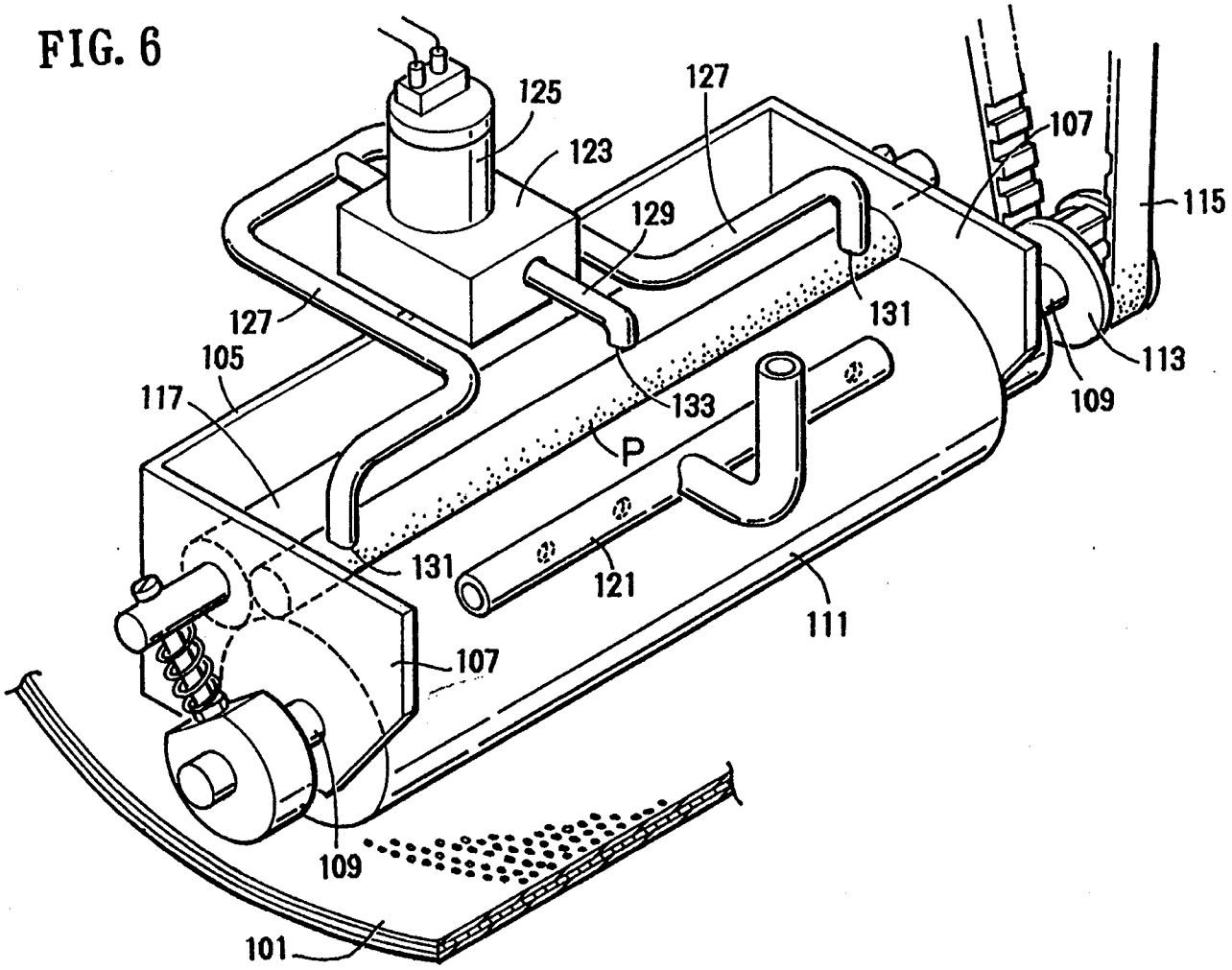
FIG. 6 is a schematic perspective view showing the ink supplying and ink level detecting device of FIG. 5.

FIGS. 5 and 6 show an embodiment of the ink supplying and ink level detecting device for a stencil printing device according to the present invention. In these drawings, numeral 101 denotes a cylindrical printing drum which may consist of perforated metallic plate, a mesh structure or otherwise ink permeable material.

The printing drum 101 is rotatively driven by driving means for the printing drum 101 not shown in the drawings around its axial center line in counter clockwise direction with a stencil printing master plate not shown in the drawings mounted on the outer circumferential surface thereof, and by pressing printing paper against the stencil printing master plate mounted on the outer circumferential surface of the printing drum 101 by means of a press roller 103, a stencil printing is carried out on the printing paper.

A staple-shaped squeegee support frame 105 is fixedly secured inside the printing drum 101. The squeegee support frame 105 rotatably supports a squeegee roller 111 via a central shaft 109 between a pair of side plates 107 thereof axially flanking the squeegee roller 111.

The squeegee roller 111 extends in the axial direction of the printing drum 101 so as to engage the inner circumferential surface of the printing drum 101, and comprises a sprocket 113 which is mounted on the central shaft 109 and a timing belt 115 passed around the sprocket 113 to rotatively drive the sprocket 113 in counter clockwise direction in synchronism with the rotation of the printing drum 101.

The squeegee support frame 105 supports a doctor rod 117 in parallel with the squeegee roller 111 between the side plates 107 so as to define a gap 119 between the outer circumferential surface of the squeegee roller 111 and the doctor rod 117 for the controlled passage of the printing ink through this gap 119.

Printing ink is supplied from an ink supplying tube 121 to the outer circumferential surface of the squeegee roller 111, and as the squeegee roller 111 rotates, the printing ink supplied from the ink supplying tube 121 forms an ink reservoir P on the squeegee roller 111 with the doctor rod 117 serving as a weir for the printing ink.

An ink circulating pump 123 is mounted on the squeegee support frame 105. The ink circulating pump 123 may consist of, for instance, a small gear pump which is actuated by a motor 125.

The ink circulating pump 123 is connected to a suction hose 127 and an ejection hose 129. The suction hose 127 is branched off into two branched parts which extend toward either axial end of the printing drum 101, and the forward end of each of the branched parts forming an ink suction port 131 opposes the corresponding axial end of the ink reservoir P from above. The vertical position of each of the suction ports is so determined that it is spaced from the upper surface of the printing ink in the ink reservoir P when the amount of the printing ink in the ink reservoir P is below a prescribed level as illustrated in FIG. 5.

The ejection hose 129 extends in an axially central part of the printing drum 101, and its forward end defines an ink ejection port 133 which opposes the ink reservoir P from above at this axially central part of the printing drum 101.

An electric current detector 135 is provided in the power circuit for the motor 125 for detecting the level of the electric current supplied to the motor 125. The level of the electric current supplied to the motor 125 detected by the electric current detector 135 is supplied to an electric current level determination circuit 137.

The electric current level determination circuit 137 compares the current level supplied from the electric current detector 135 with a predetermined reference level. If the detected current level is higher than the reference level, the determination circuit 137 produces an ink amount detection signal indicating that the amount of the printing ink in the ink reservoir P is greater than a predetermined level. On the other hand, if the detected current level is lower than the reference level, the determination circuit 137 produces an ink amount detection signal indicating that the amount of the printing ink in the ink reservoir P is less than the predetermined level.

According to the above described structure, the ink circulating pump 123 is rotatively driven by the motor 125, and the activation of the ink circulating pump 123 produces a suction force at each of the ink suction ports 131. If the amount of the printing ink in the ink reservoir P at this time is greater than the predetermined level, the ink suction ports 131 contact the printing ink in the ink reservoir at the two axial end portions of the printing drum 101, and draw the printing ink thereinto. The printing ink drawn into the ink suction ports 131 is conducted by the suction hose 127 to the ink circulating pump 123, and is then expelled from the ink ejection port 133 via the ink ejection hose 129 eventually to be returned to the ink reservoir P at the axially central part of the printing drum 101.

As a result of the flow of the printing ink caused by the ink circulating pump 123, the printing ink in the ink reservoir P is allowed to be circulated in the axial direction of the printing drum 101, and the printing ink in the parts of the ink reservoir P corresponding to the axial end portions of the printing drum 101 is prevented from being kept unused for an extended period of time.

During the time the ink circulating pump 123 is drawing the printing ink from the ink suction ports 131, the load of the motor 125 in driving the ink circulating pump 123 is great as compared to the time when the ink circulating pump 123 is drawing air, and the electric current of the motor 125 detected by the electric current detector 135 is determined to be greater than the reference value at the electric current level determination circuit 137.

Thus, the electric current level determination circuit 137 determines that the electric current of the motor 125 detected by the electric current detector 135 is greater than the reference value according to the result of comparison between the detected current value and the reference value, and produces an ink amount detection signal indicating that the level of the printing ink in the ink reservoir P is higher than the predetermined level.

When the printing ink in the ink reservoir P is consumed, and the level of the printing ink drops below a prescribed level, the ink suction ports 131 are spaced from the printing ink of the ink reservoir P, and start drawing air. In this case, the load of the motor 125 in driving the ink circulating pump 123 is less as compared to the time when the ink circulating pump 123 is drawing printing ink, and the electric current of the motor 125 detected by the electric current detector 135 is determined to be less than the reference value at the electric current level determination circuit 137. As a result, the electric current level determination circuit 137 determines that the electric current of the motor 125 detected by the electric current detector 135 is less than the reference value according to the result of comparison between the detected current value and the reference value, and produces an ink amount detection signal indicating that the amount of the printing ink in the ink reservoir P is lower than the predetermined level.

In such a time, the printing ink supplied from an ink tank not shown in the drawings may be supplied to the ink reservoir P via the ink supplying tube 121 in a well known manner.

Figure 7:
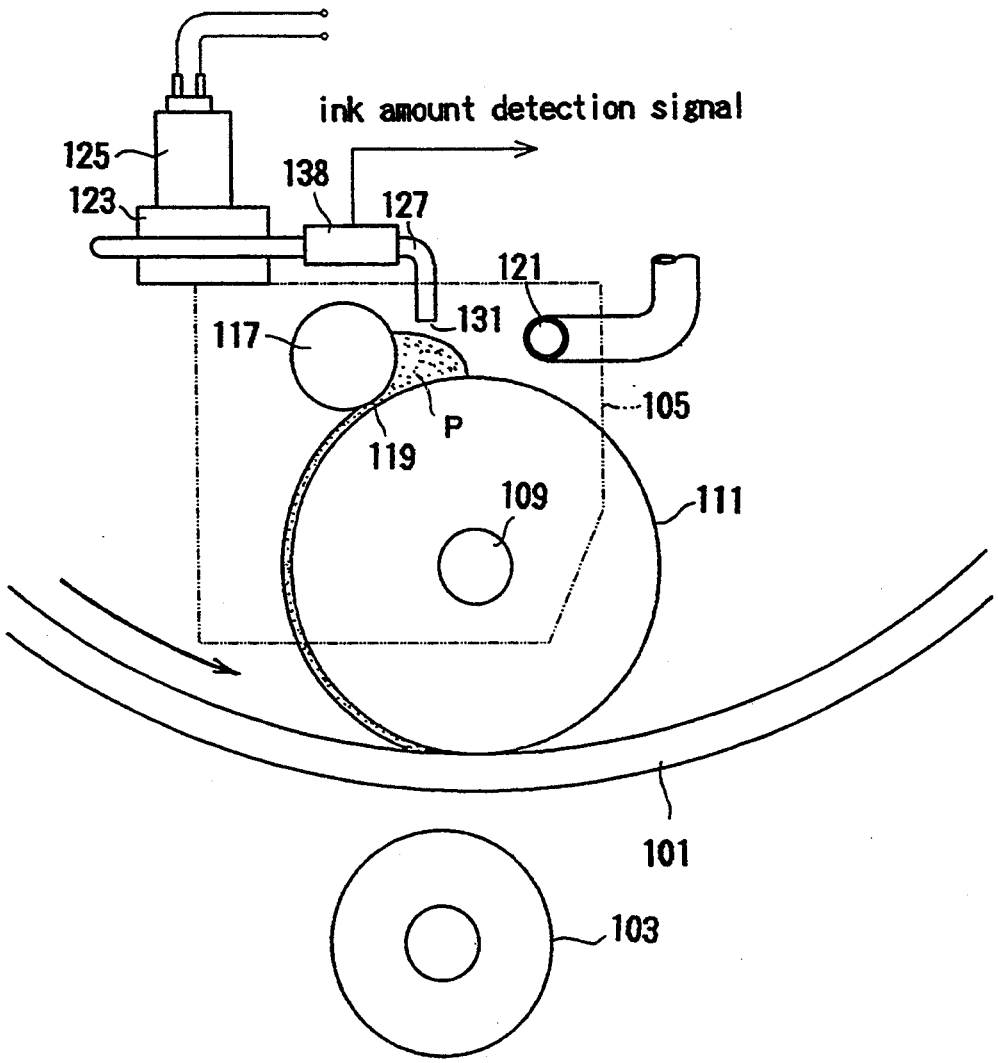
FIG. 7 is a view similar to FIG. 5 showing another embodiment of the ink supplying and ink level detecting device for the stencil printing device according to the present invention.

In the above described embodiment, whether the ink circulating pump 123 is drawing the printing ink or not was detected by the change in the electric current supplied to the motor 125, but it is also possible to employ an ink flow sensor 138 connected to an intermediate part of the suction hose 127 as illustrated in FIG. 7 for detecting whether the printing ink is flowing through the suction hose 127 or not. The ink flow sensor 138 may consist of, for instance, a flapper type sensor in which the movement of a flapper due to the dynamic pressure of the flow of the printing ink is detected by a limit switch or the like.

When the suction hose 127 is bifurcated or branched as illustrated in FIG. 6, the ink flow sensor 138 may be provided in either of the branched parts, in each of the branched parts, or only in a trunk part of the suction hose 127. If the ink flow sensors 138 are provided in the two branched parts of the suction hose 127, the outputs from the sensors may be subjected to AND, OR or other logic processes to be converted into an ink level indication signal, and such details should be optimally determined according to the shape of the ink in the ink reservoir P and other considerations.

In this case, the vertical positions of the two ink suction ports 131 are not required to be the same, and may be different from each other. In this case, it is possible to detect two levels of the printing ink in the ink reservoir, and the additional level signal can be utilized for controlling the process of an ink supply interruption in the case of excessive increase in the amount of the printing ink in the ink reservoir P.

Figure 8:
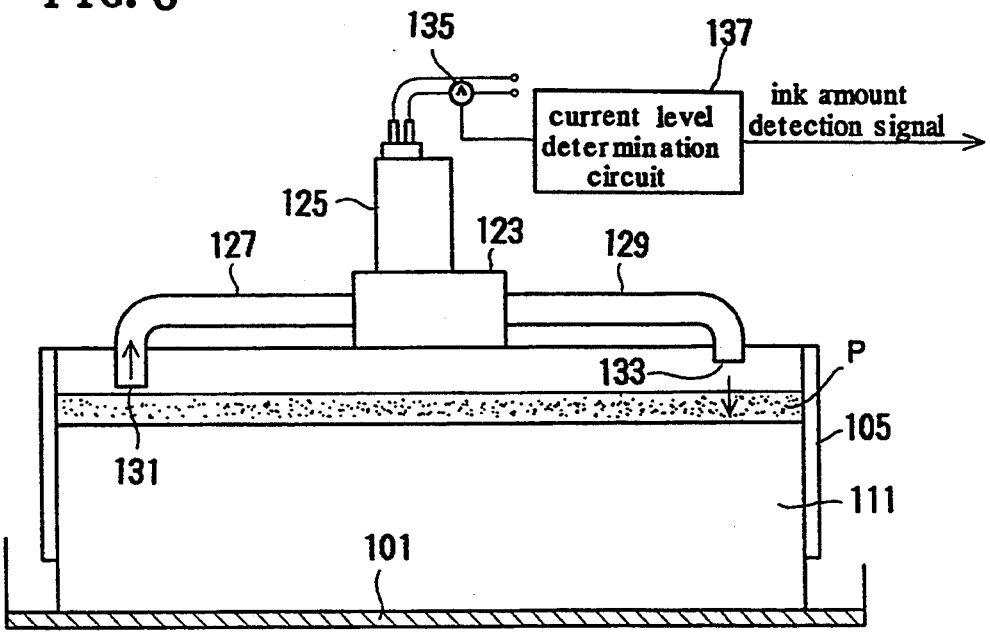
FIG. 8 is a schematic structural view showing yet another embodiment of the ink supplying and ink level detecting device for the stencil printing device according to the present invention.
Figure 9:
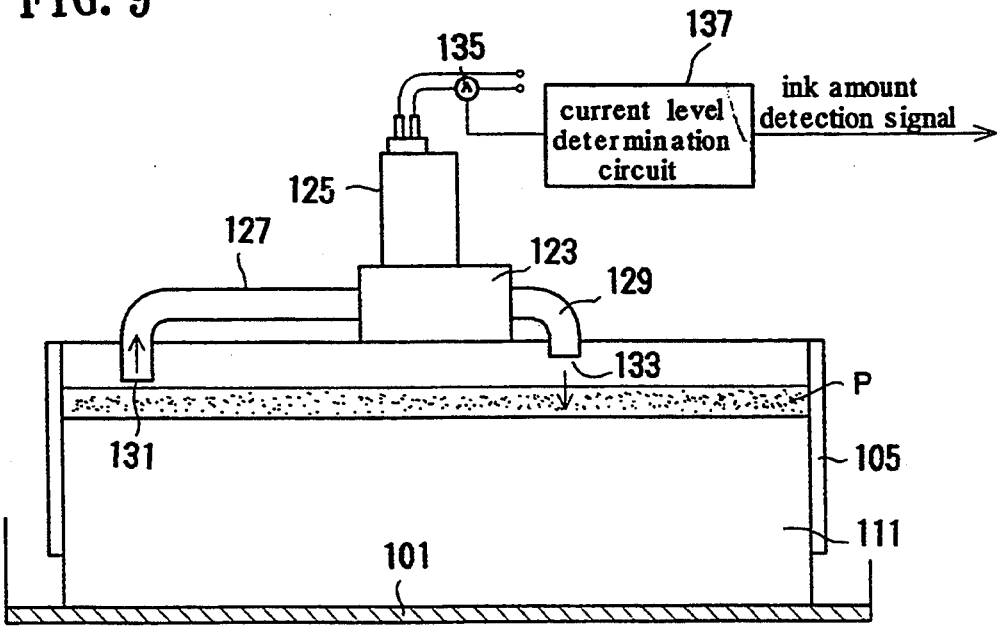
FIG. 9 is a schematic structural view showing yet another embodiment of the ink supplying and ink level detecting device for the stencil printing device according to the present invention.

In the above described embodiment, the suction hose 127 was branched off into two branched parts so that the printing ink may be drawn from the two axial ends of the printing drum 101, and returned to the axially central part of the printing drum 101, but it is also possible to extend the suction hose 127 in only one axial direction of the printing drum 101 and extend the ejection hose 129 in the opposite axial direction of the printing drum 101 as illustrated in FIG. 8 so that the ink suction port 131 may be provided only in one axial end of the printing drum 101 while the ejection port 133 opens out in the other axial end of the printing drum 101. Alternatively, it is also possible to extend the suction hose 127 in one axial direction of the printing drum as illustrated in FIG. 9 so that the ink suction port 131 may be located in only one axial end of the printing drum while the ink ejection port 133 of the ejection hose 129 is located in the axially central part of the printing drum 101.

In either case, as the ink circulating pump 123 draws the printing ink stored in the ink reservoir P from the ink suction port 131, and ejects the printing ink to the ink reservoir P from the ink ejection port 133, the printing ink in the ink reservoir P is forced to circulate in the axial direction, and it is prevented that the printing ink located in either axial end portions of the printing drum be kept unused for an extended period of time.

Although it is not shown in the drawings, if only the detection of the level of the printing ink in the ink reservoir is of interest, the ink suction port 131 may be located in an axially central part of the printing drum 101 while the ink ejection port 133 is provided in an axial end portion of the printing drum 101, or, alternatively, the ink suction port 131 and the ink ejection port 133 may even be located in an axially same position.

Figure 10:
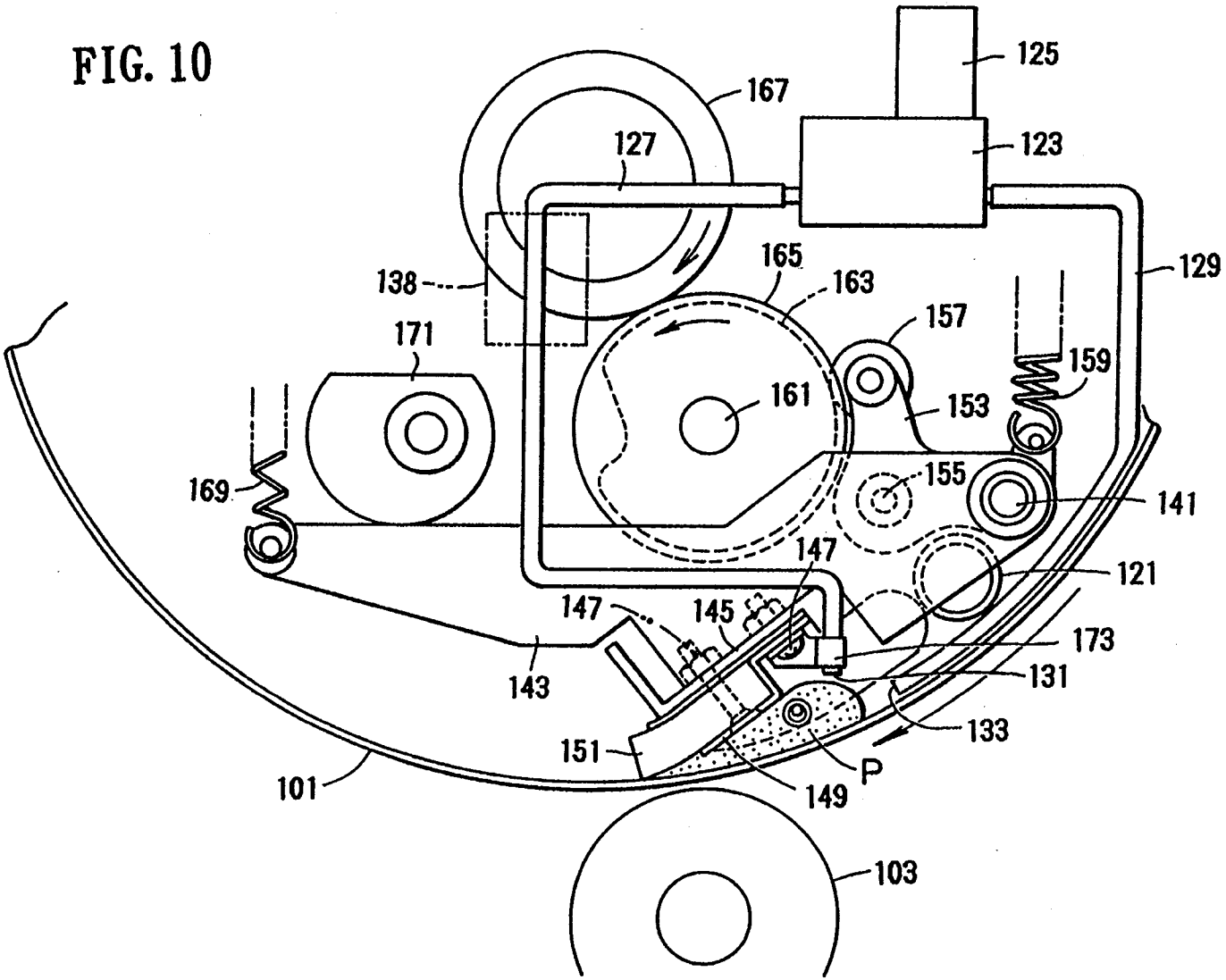
FIG. 10 is a side view showing yet another embodiment of the ink supplying and ink level detecting device for the stencil printing device according to the present invention.

FIG. 10 shows another embodiment of the ink supplying and ink level detecting device for a stencil printing device according to the present invention. In FIG. 10, the parts corresponding to those shown in FIGS. 5 and 6 are denoted with like numerals. In this embodiment, a pair of squeegee support side plates 143 which are connected to each other by a connecting shaft 141 extending in the axial direction of the printing drum 101 are provided inside the printing drum 101, and these squeegee support side plates 143 support a squeegee blade 151 in parallel with the axial line of the printing drum 101 by way of a squeegee support base plate 145 extending across the squeegee support side plates 143 and a squeegee support mounting plate 149 fixedly secured to the squeegee support base plate 145 by screws 147.

The squeegee blade 151 consists of a rubber-like elastic material such as urethane rubber, and extends in the axial direction of the printing drum 101 by being supported by the squeegee support base plate 145 and the squeegee support mounting plate 149 in the manner of a cantilever so that the edge on the free end of the squeegee blade 151 may be pushed against the inner circumferential surface of the printing drum 101 at a certain squeegee angle.

In this case, with the printing ink supplied to the inner circumferential surface of the printing drum 101 via the ink supplying tube 121, as the printing drum 101 rotates in clockwise direction as seen in the drawing, an ink reservoir P is formed in a triangular region which is defined behind the line of contact between the squeegee blade 151 and the printing drum 101 as seen in the direction of rotation of the printing drum 101, or to the right of the line of contact as seen in FIG. 10.

One end of a swing lever 153 is pivotally mounted on the connecting shaft 141, and this swing lever 153 is rotatively supported by a support shaft 155 mounted on a fixed frame not shown in the drawing at an intermediate point thereof, and rotatably supports a cam follower roller 157 at the other end thereof.

Because the swing lever 153 is urged in counter clockwise direction by a spring 159 mounted on the connecting shaft 141, the cam follower roller 157 engages with a cam 163 of a cam shaft 161 rotatably supported by the aforementioned fixed frame. The cam shaft 161 is rotatively driven at one to one speed ratio in synchronism with the rotation of the printing drum 101 via gears 165 and 167.

Each of the squeegee support side plates 143 is urged upward by a spring 169 at the other end thereof so that this other end may engage with an eccentric cam 171 which is adjustably mounted on the fixed frame.

By virtue of this contact mechanism and the aforementioned cam mechanism, the squeegee support side plates 143 and the squeegee blade 151 associated therewith are forced away from the inner circumferential surface of the printing drum 101 in the angular interval of the printing drum 101 corresponding to the non-ink permeable part of the printing drum 101 where the stencil printing master plate head clamping portion is located.

This embodiment also comprises an ink circulating pump 123, and ink suction ports 131 are placed above the ink reservoir P by using a suction hose 127. Ink suction ports 131 are mounted to support base plate 145 by screws 147 and collar 173. Further, an ink ejection port 133 is placed adjacent a position of the printing drum 101 slightly behind the ink reservoir P as seen in the direction of rotation of the printing drum 101. Thus, the ink circulating pump 123 draws the printing ink of the ink reservoir P from the ink suction ports 131, and returns the printing ink to the ink reservoir P from the ink ejection port 133.

Although it is not explicitly illustrated in the drawing, in this case also, the ink suction ports 131 are placed in either axial end portions of the ink reservoir P while the ink ejection port 133 is placed in an axially central part of the ink reservoir P.

Thus, according to this embodiment also, the printing ink in the ink reservoir P can circulate in the axial direction of the printing drum 101, and the printing ink in the parts of the ink reservoir P corresponding to the axial end portions of the printing drum 1 is prevented from being kept unused for an extended period of time.

Figure 11:
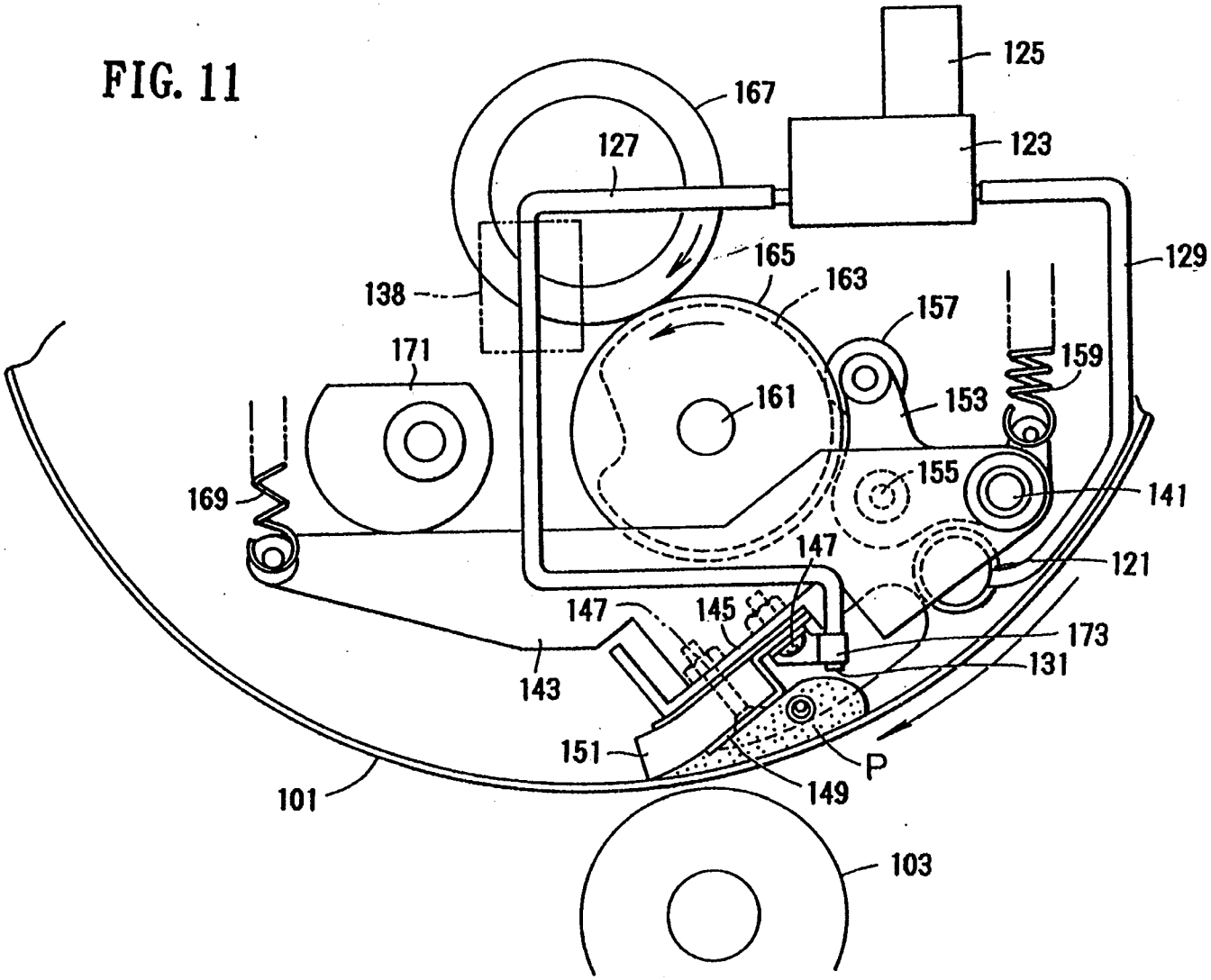
FIG. 11 is a view similar to FIG. 10 showing yet another embodiment of the ink supplying and ink level detecting device for the stencil printing device according to the present invention.

FIG. 11 shows another embodiment of the ink supplying and ink level detecting device for a stencil printing device according to the present invention. In FIG. 11, the parts corresponding to those shown in FIG. 10 are denoted with like numerals. In this embodiment, the ejection hose 129 is connected to the ink supplying tube 121 so that the printing ink of the ink reservoir P drawn by the ink circulating pump 123 from the ink suction port 131 is supplied to the ink supplying tube 121, and is then returned to the ink reservoir P via the ink supplying tube 121.

Thus, in this embodiment also, the printing ink in the ink reservoir P can circulate in the axial direction of the printing drum 101, and the printing ink in the parts of the ink reservoir P corresponding to the axial end portions of the printing drum 101 is prevented from being kept unused for an extended period of time.

In either of the disclosed embodiments, the ink circulating pump 123 was actuated by a dedicated motor 125, but the ink circulating pump 123 may be connected to the actuating system for the printing drum 101 so that it may be rotatively driven by the rotation of the printing drum 101.

As can be understood from the above description, according to the ink supplying and ink level detecting device for a stencil printing device according to the present invention, since the printing ink can circulate in the ink reservoir as the ink circulating pump draws the printing ink of the ink reservoir from the ink suction ports, and eject the printing ink back to the ink reservoir P, the printing ink in the parts of the ink reservoir P corresponding to the axial end portions of the printing drum is prevented from being kept unused for an extended period of time, and is therefore prevented from becoming degraded in time. Thus, even when the printing ink consists of an emulsion type printing ink, the drop in the viscosity of the printing ink due to the change in the condition of the emulsion can be avoided, and a stable print quality can be maintained at all times. Further, leakage of the printing ink from the ink reservoir due to the drop in the viscosity of the printing ink can be also avoided.

Figure 12:
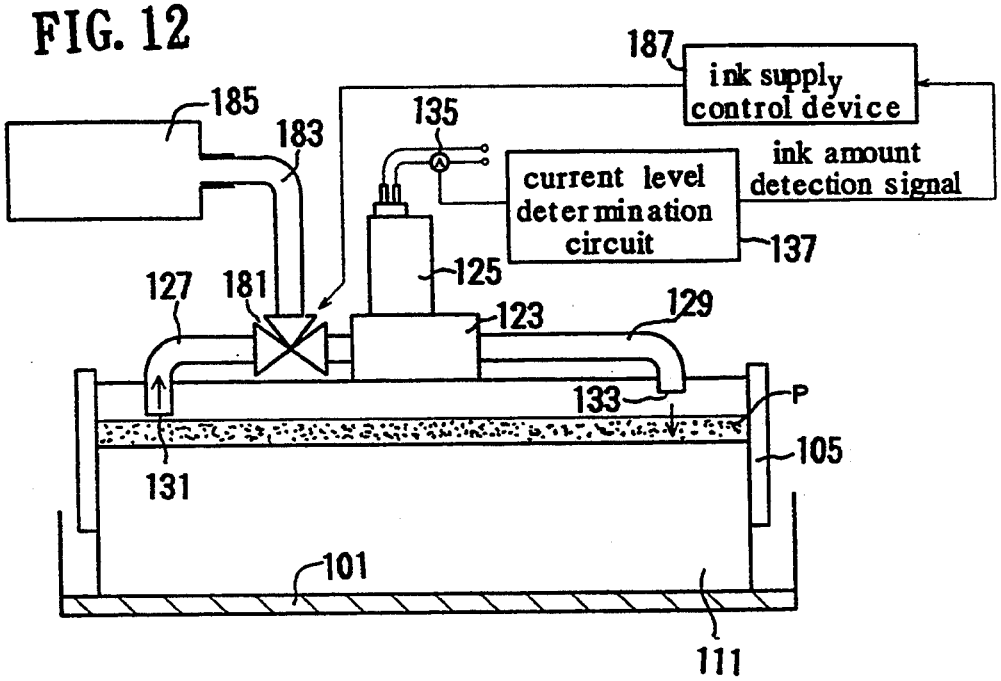
FIG. 12 is a schematic structural view showing yet another embodiment of the ink supplying and ink level detecting device for the stencil printing device according to the present invention.

FIG. 12 shows an embodiment of an ink supplying and ink level detecting device for a stencil printing device according to the present invention. In this embodiment, a flow switching valve 181 is provided in an intermediate part of the suction hose 127, and can selectively connect the ink circulating pump 123 to either one of the ink suction port 131 and the ink supplying hose 183. The ink supplying hose 183 is connected to an ink bottle 185 serving as an ink tank.

The flow switching valve 181 is controlled by an ink supply control device 187 which receives the ink level detection signal from the electric current determination circuit 137. When the ink level detection signal from the electric current determination circuit 137 indicates that the level of the ink in the ink reservoir P is higher than the prescribed level, the ink supply control device 187 disconnects the ink circulating pump 123 from the ink supplying hose 183, and connects it to the ink suction port 131. On the other hand, when the ink level detection signal from the electric current determination circuit 137 indicates that the level of the ink in the ink reservoir P is lower than the prescribed level, the ink supply control device 187 sends a drive signal to the flow switching valve 181 so as to disconnect the ink circulating pump 123 from the ink suction port 131, and connects it to the ink supplying hose 183.

As a result, when the level of the printing ink in the ink reservoir P is higher than the prescribed level, the ink circulating pump 123 is disconnected from the ink supplying hose 183, and is connected to the ink suction port 131 so that the printing ink of the ink reservoir P drawn from the ink suction port 133 may be returned to the ink reservoir P.

When the level of the printing ink in the ink reservoir P has dropped below the prescribed level, and the ink circulating pump P stops drawing the printing ink of the ink reservoir P from the suction port 131, the drive signal produced from the ink supply control device 187 switches over the flow switching valve 181 so as to connect the ink circulating pump 123 to the ink supplying hose 183 instead of the ink suction port 131. Thus, the ink circulating pump 123 starts drawing the printing ink from the ink bottle 185, and the printing ink from the ink bottle 185 is now supplied to the ink reservoir P via the ink ejection port 133.

When the ink circulating pump 123 starts drawing the printing ink from the ink bottle 185, the ink level detection signal from the electric current level determination circuit 137 is reversed. To avoid the occurrence of undesirable hunting, this signal is cancelled so that the ink circulating pump 123 may continue to draw the printing ink from the ink bottle 185 over a certain period of time by suitable time control or the like.

In this case, the ink supplying pump for supplying the printing ink from the ink bottle 185 to the ink reservoir P may be omitted, and it is also possible to detect the depletion of printing ink from the ink bottle 185 according to the ink level detection signal produced from the electric current level determination circuit 137.

In this embodiment also, it is also possible to detect if the ink circulating pump 123 is drawing the printing ink or not by using a flow sensor 138 provided in an intermediate part of the suction hose 127.

As can be understood from the above description, according to the ink level detecting device for a stencil printing device according to the present invention, since the suction port of the ink circulation pump is spaced from the printing ink in the ink reservoir when the level of the printing ink in the ink reservoir is below a prescribed level, and there is provided an ink suction detecting means for detecting whether the ink circulating pump is drawing the printing ink or not, when the level of the printing ink in the ink reservoir is below a prescribed level, the ink circulating pump starts drawing air instead of the printing ink. It is detected by the ink suction detecting means as an indication that the level of the printing ink in the ink reservoir is below the prescribed level. Thus, the present invention allows erroneous detection results to be avoided, and the level of the printing ink in the ink reservoir can be determined in both reliable and stable manner even when the ink reservoir is provided in a highly limited space between the squeegee member and the metallic printing drum.

Although the present invention has been described in terms of specific embodiments thereof, it is possible to modify and alter details thereof without departing from the spirit of the present invention.

What we claim is:

1. A stencil printing device, comprising:

a plurality of printing drums arranged in a single row from a first most upstream printing drum to a last most downstream printing drum along an inclined line of a prescribed inclination angle relative to a horizontal line in mutually spaced relationship, each of said printing drums being rotatively driven around an axial center line thereof;

a plurality of stencil printing master plate feeding means disposed above said inclined line respectively in association with each of said plurality of printing drums, each of said stencil printing master plate feeding means comprising a plate making portion for processing a stencil printing master plate sheet, and a stencil printing master plate sheet feeding portion for delivering said stencil printing master plate sheet processed by said plate making portion to an outer circumferential surface of said corresponding printing drum;

a plurality of plate ejection means disposed above said inclined line respectively in association with each of said printing drums for removing a stencil printing master plate mounted on said outer circumferential surface of respective ones of said plurality of printing drums therefrom;

squeegee means disposed inside each of said printing drums for supplying printing ink to said outer circumferential surface of said printing drum;

a press roller disposed below said inclined line and opposite to said outer circumferential surface of each of said printing drums for pressing printing paper against said outer circumferential surface of said printing drum;

printing paper conveying means disposed between each pair of mutually adjacent ones of said printing drums for conveying printing paper along said inclined line from an upstream one of said pair of adjacent printing drums to a nip defined between a downstream one of said adjacent pair of printing drums and said corresponding press roller;

timing roller means for supplying printing paper to a nip defined between said most upstream printing drum and said corresponding press roller at an appropriate timing;

paper feed means disposed below said inclined line for delivering said printing paper to said timing roller means; and paper ejection means for ejecting paper from said most downstream printing drum.

2. A stencil printing device according to claim 1, wherein each of said plurality of stencil printing master plate feeding means is disposed on a side of said corresponding printing drum remote from said inclined line.

3. A stencil printing device according to claim 1, wherein said plurality of plate ejection means is disposed on a side of said corresponding printing drum remote from said inclined line.

4. A stencil printing device according to claim 2, wherein each of said plurality of plate ejection means is disposed below said stencil printing master plate feeding means.

5. A stencil printing device according to claim 2, wherein said stencil printing device further comprises a substantially box-shaped cabinet, and said inclined line extends substantially diagonally across the interior of said cabinet in a plane perpendicular to said central axial lines of said printing drums, said paper feeding means being disposed in a first corner portion of said cabinet below said inclined line.

6. A stencil printing device according to claim 5, further comprising image reading means for photoelectrically reading an image from an original, and plate making data processing means for receiving an image signal supplied from said image reading means and supplying a plate making data signal to said plate making portion of each of said plurality of stencil printing master plate feeding means, said image reading means being disposed in a second corner portion of said cabinet above said inclined line and diagonally opposite to said first corner.

7. A stencil printing device according to claim 1, further comprising image reading means for photoelectrically reading an image from an original, and plate making data processing means for receiving an image signal from said image reading means and supplying a plate making data signal to said plate making portion of each of said plurality of stencil printing master plate feeding means, said plate making portion of each of said plurality of stencil printing master plate feeding means being adapted to digitally produce a stencil printing master plate according to said plate making data signal supplied from said plate making data processing means.

8. A stencil printing device according to claim 1, further comprising image reading means for photoelectrically reading an image from an original and generating an image signal therefor, and plate making data processing means for receiving said image signal from said image reading means and supplying plate making data signals based on colors in the original to said plate making portion of each of said plurality stencil printing master plate feeding means, said plate making portion of each of said plurality of stencil printing master plate feeding means being adapted to digitally produce stencil printing master plates according to said plate making data signals supplied from said plate making data processing means.

9. A stencil printing device according to claim 1, further comprising, for each of said printing drums, an ink supplying device which includes an ink circulating pump comprising an ink suction port and an ink expelling port provided in two separate positions, wherein printing ink is stored in an ink reservoir provided in said printing drum and is drawn into said ink suction port, and said printing ink is expelled from said ink expelling port to said ink reservoir.

10. A stencil printing device, comprising:

a plurality of printing drums arranged in a single row from a first most upstream printing drum to a last most downstream printing drum along an inclined line of a prescribed inclination angle relative to a horizontal line in mutually spaced relationship, each of said printing drums being rotatively driven around an axial center line thereof;

a stencil printing master plate feeding means disposed above said inclined line in association with each of said printing drums, said stencil printing master plate feeding means comprising a plate making portion for processing a stencil printing master plate sheet, and a stencil printing master plate sheet feeding portion for delivering said stencil printing master plate sheet processed by said plate making portion to an outer circumferential surface of said corresponding printing drum;

a plurality of plate ejection means disposed above said inclined line respectively in association with each of said printing drums for removing a stencil printing master plate mounted on said outer circumferential surface of respective ones of said plurality of printing drums therefrom;

squeegee means disposed inside each of said printing drums for supplying printing ink to said outer circumferential surface of said printing drum;

a press roller disposed below said inclined line and opposite to said outer circumferential surface of each of said printing drums for pressing printing paper against said outer circumferential surface of said printing drum;

printing paper conveying means disposed between each pair of mutually adjacent ones of said printing drums for conveying printing paper along said inclined line from an upstream one of said pair of adjacent printing drums to a nip defined between a downstream one of said adjacent pair of printing drums and said corresponding press roller;

timing roller means for supplying printing paper to a nip defined between said most upstream printing drum and said corresponding press roller at an appropriate timing;

paper feed means disposed below said inclined line for delivering said printing paper to said timing roller means; and paper ejection means for ejecting paper from said most downstream printing drum, wherein said stencil printing master plate feeding means consists of a single unit which moves along said inclined line so that said single stencil printing master plate feeding means supplies a stencil printing master plate to each of said printing drums in a sequential manner.

11. A stencil printing device, comprising:

a plurality of printing drums arranged in a single row from a first most upstream printing drum to a last most downstream printing drum along an inclined line of a prescribed inclination angle relative to a horizontal line in mutually spaced relationship, each of said printing drums being rotatively driven around an axial center line thereof;

a stencil printing master plate feeding means disposed above said inclined line in association with each of said plurality of printing drums, said stencil printing master plate feeding means comprising a plate making portion for processing a stencil printing master plate sheet, and a stencil printing master plate sheet feeding portion for delivering said stencil printing master plate sheet processed by said plate making portion to an outer circumferential surface of said corresponding printing drum;

plate ejection means disposed above said inclined line in association with each of said printing drums for removing a stencil printing master plate mounted on said outer circumferential surface of said plurality of printing drums therefrom;

squeegee means disposed inside each of said printing drums for supplying printing ink to said outer circumferential surface of said printing drum;

a press roller disposed below said incline line and opposite to said outer circumferential surface of each of said printing drums for pressing printing paper against said outer circumferential surface of said printing drum;

printing paper conveying means disposed between each pair of mutually adjacent ones of said printing drums for conveying printing paper along said printing line from an upstream one of said pair of adjacent printing drums to a nip defined between a downstream one of said adjacent pair of printing drums and said corresponding press roller;

timing roller means for supplying printing paper to a nip defined between said most upstream printing drum and said corresponding press roller at an appropriate timing;

paper feed means disposed below said inclined line for delivering said printing paper to said timing roller means; and paper ejection means for ejecting paper from said most downstream printing drum, wherein the stencil printing device further comprises, for each of said printing drums, an ink level detecting device which comprises:

an ink circulating pump which comprises an ink suction port and an ink ejection port, for drawing said printing ink received in an ink reservoir provided in said printing drum from said ink suction port and returning said printing ink back to said ink reservoir from said ink ejection port, said ink suction port being located at a position spaced from said printing ink in said ink reservoir when said level of said printing ink in said ink reservoir is below a prescribed level; and ink suction detecting means for determining if said ink circulating pump is drawing said printing ink or not; said level of said printing ink in said ink reservoir being determined to be below said prescribed level or not according to a result of determination by said ink suction detecting means.

* * * * *